United States Patent [19]

MacMaster et al.

[11] Patent Number: 4,677,342

[45] Date of Patent: Jun. 30, 1987

[54] SEMICONDUCTOR SECONDARY EMISSION CATHODE AND TUBE

[75] Inventors: George H. MacMaster, Lexington; Lawrence J. Nichols, Burlington, both of Mass.

[73] Assignee: Raytheon Company, Lexington, Mass.

[21] Appl. No.: 697,540

[22] Filed: Feb. 1, 1985

[51] Int. Cl.[4] ..... H01J 25/34

[52] U.S. Cl. ..... 315/39.3; 313/103 R; 313/346 R; 315/39.51

[58] Field of Search ..... 315/39.3, 39.51; 313/103, 346, 104, 105, 340, 337

[56] References Cited

U.S. PATENT DOCUMENTS

| | | | |
|---|---|---|---|
| 3,096,457 | 7/1963 | Smith, Jr. et al. | 313/103 |
| 3,223,882 | 12/1965 | Thal, Jr. | 315/39.3 |
| 3,255,422 | 6/1966 | Feinstein et al. | 315/39.3 X |
| 3,364,367 | 1/1968 | Brody | 313/103 X |
| 3,478,213 | 11/1969 | Simon et al. | 313/103 X |
| 3,596,131 | 7/1971 | Wilczek | 313/103 |
| 3,611,077 | 10/1971 | Smith | 313/346 R |
| 4,019,082 | 4/1977 | Olsen et al. | 313/103 R |
| 4,028,583 | 6/1977 | Bigham | 313/103 |
| 4,200,821 | 4/1980 | Bekefi et al. | 315/39.51 |
| 4,410,833 | 10/1983 | Ganguly et al. | 315/39.51 |

FOREIGN PATENT DOCUMENTS

| | | |
|---|---|---|
| 0066926 | 5/1982 | European Pat. Off. . |
| 967066 | 8/1964 | United Kingdom . |
| 1023257 | 3/1966 | United Kingdom . |
| 1233721 | 5/1971 | United Kingdom . |
| 1377566 | 12/1974 | United Kingdom . |
| 1387004 | 3/1975 | United Kingdom . |
| 1446592 | 8/1976 | United Kingdom . |
| 1538738 | 1/1979 | United Kingdom . |
| 1533657 | 11/1979 | United Kingdom . |
| 1582204 | 1/1981 | United Kingdom . |

OTHER PUBLICATIONS

U.S. patent application Ser. No. 812,155, filed 12-23-85, by George H. MacMaster et al, entitled, "A P-N Junction Semiconductor Secondary Emission Cathode and Tube".

*Primary Examiner*—Saxfield Chatmon

*Attorney, Agent, or Firm*—Martin M. Santa; Richard M. Sharkansky

[57] ABSTRACT

The cathode and tube of this invention comprise a secondary emission semiconductor cathode in a crossed-field high power amplifier. A gallium arsenide semiconductor doped with an impurity to make it more conductive than intrinsic gallium arsenide has been found to perform better than prior art secondary emission cathodes when it is incorporated as a cathode in a high-power crossed-field amplifier tube operating at high average and peak current. With a gallium arsenide cathode, the crossed-field amplifier tube exhibits a radio frequency output pulse which has fast rise time and much reduced leading-edge jitter relative to performance of the same cross-field amplifier tube having a conventional secondary emission cathode.

16 Claims, 6 Drawing Figures

SEMICONDUCTOR SECONDARY EMISSION CATHODE AND TUBE

BACKGROUND OF THE INVENTION

This invention relates generally to secondary emission cathodes and more particularly to a semiconductor secondary emission cathode in a high-power cross-field tube which requires a cathode capable of providing high current density.

The prior art secondary emission cathodes made of very thin insulating films, BeO, AlO and MgO for example, with thickness approximating 50 Angstroms, possess enhanced conductivity due to tunneling. Therefore, they are capable of providing high current densities (approximately 1 to 10 amperes per square centimeter) which allows these films to be used as secondary emission cathodes in crossed-field high power tubes. However, these thin films are eroded away by electron bombardment in a relatively short time. These films are typically of a material such as magnesium oxide which have a limited life in their application to high power tubes and require extensive time for out-gassing the tube during manufacture in order to allow them to be used at high powers. In order to increase the longevity of the cathode but without improving the out-gassing problem, thicker films for the cathode are desired. Thicker films introduce problems with respect to the effective conductivity of such films which results in the presence of charging effects within the films and an impairment of the available current density relative to that obtained from the very thin insulating films. One attempt in the prior art to the solution of the problem of obtaining greater electronic conduction in thick insulating films is to introduce metallic particles in the insulating film. An example of such a material is magnesium oxide containing gold particles. The metallic particles do result in improved conductivity of the material. However, there is a significant degradation in the secondary emission ratio. In addition, the slight increase in thickness allowed by the addition of metallic particles would not be expected to meet the requirements for a long-life cathode.

It is therefore an object of this invention to provide a secondary emission cathode which is capable of operating at high current density and has a long life because its enhanced conductivity allows a thicker cathode to be used. It is a further object of this invention to provide a secondary emission cathode which will withstand the electron bombardment experienced in its use in a high-power crossed-field vacuum tube. It is a feature of this invention that the out-gassing time of a tube constructed using the semiconductor cathode is small relative to prior art cathodes since there is no oxygen in the semiconductor cathode in contrast with the thin film oxide cathodes. It is a further feature of this invention that pulsed operation of the tube of this invention has an output pulse with fast rise time and non-discernable jitter of the leading edge of the pulse as measured within the few nanosecond limitations of the instrumentation.

SUMMARY OF THE INVENTION

The aforementioned problems are overcome and other objects and advantages of this invention are provided by a cathode and tube in accordance with this invention which comprises a secondary emission semiconductor cathode. A gallium arsenide semiconductor doped with an impurity to make it more conductive than intrinsic gallium arsenide has been found to perform better than prior art secondary emission cathodes when it has been incorporated as a cathode in a high-power crossed-field amplifier tube operating at high average and peak current. With a gallium arsenide cathode, the crossed-field amplifier tube exhibits a radio frequency output pulse which has fast rise time and much reduced leading-edge jitter relative to performance of the same cross-field amplifier tube having a conventional secondary emission cathode.

BRIEF DESCRIPTION OF THE DRAWINGS

The aforementioned aspects and other features of the invention are presented in the following description taken in conjunction with the accompanying drawings wherein.

DESCRIPTION OF THE PREFERRED EMBODIMENT

Figure 1:
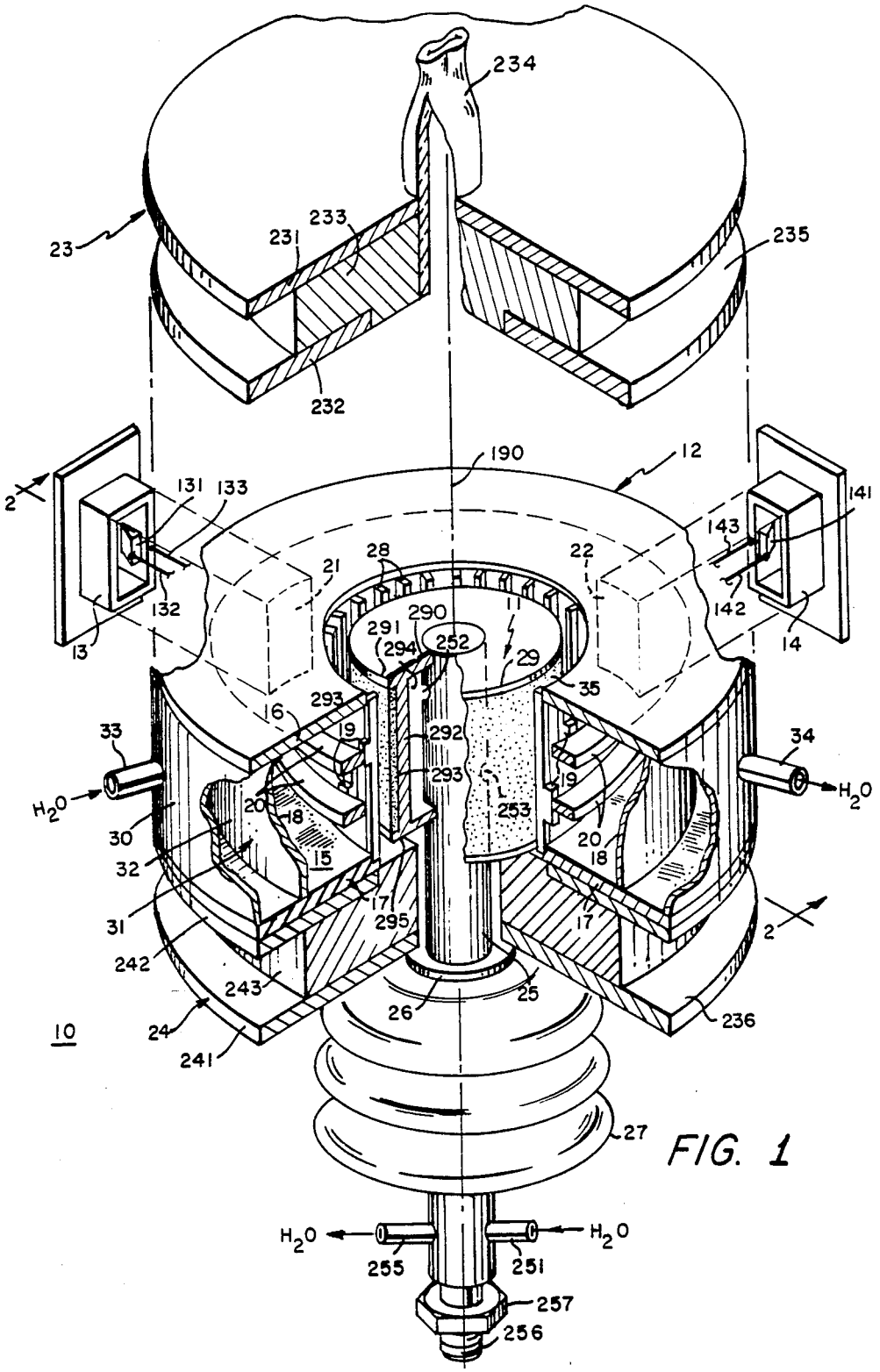
FIG. 1 is a partial cross-section, partially exploded isometric view of a crossed-field amplifier tube including the cathode of this invention.
Figure 2:
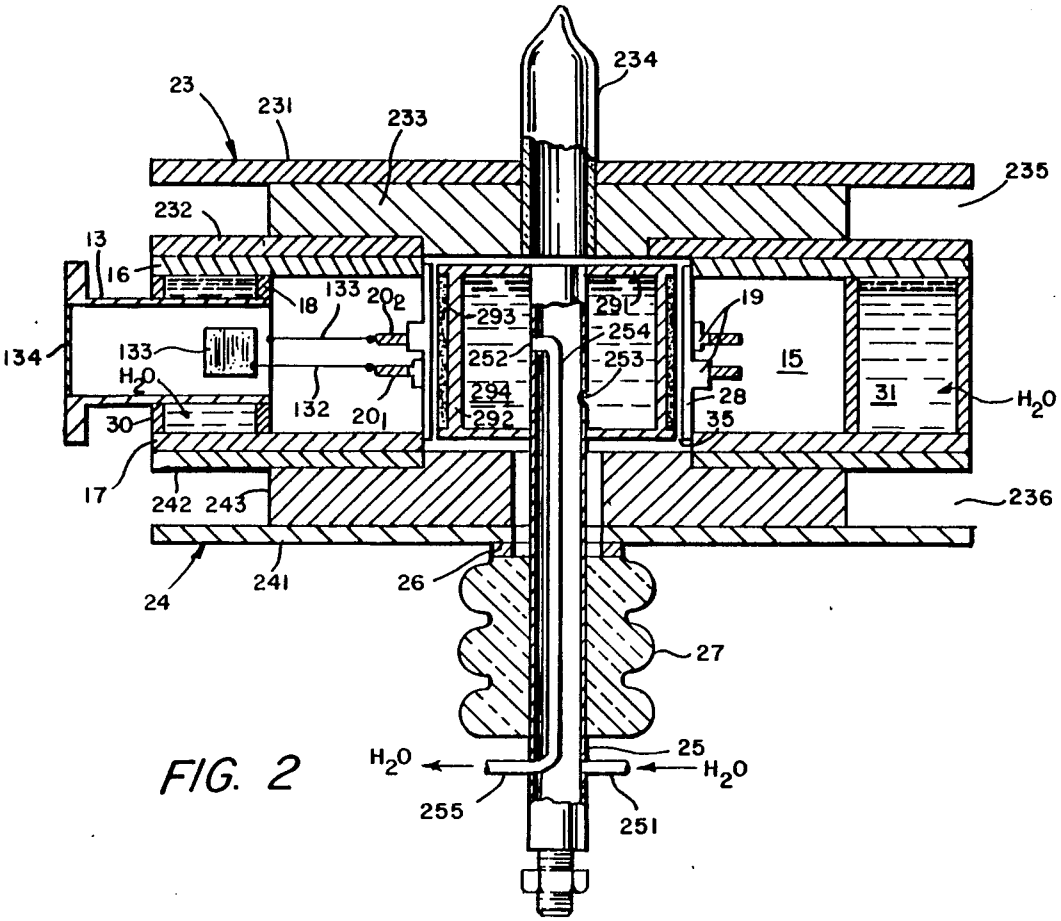
FIG. 2 is a cross-sectional view of the assembled amplifier tube of FIG. 1 taken along section lines 2—2.

A crossed-field amplifier tube 10 which includes a semiconductor cathode 11 is shown in the partial cross-section, partially exploded view of FIG. 1. The tube 10 comprises an anode 12 having an input waveguide 13 and an output waveguide 14. The anode comprises a cavity 15 formed by upper and lower walls 16, 17, respectively, an outer wall 18, and vanes 28 extending parallel to the axis of symmetry 190 of the tube. The vanes 28 also extend radially and are attached at their ends to the upper and lower walls 16, 17, respectively. Each vane 28 has a radially extending tab 19. The tabs 19 are longitudinally displaced from each other on adjacent vanes 28 with alternate vanes having their respective tabs in the same longitudinal plane. Mode suppression rings 20, longitudinally displaced from each other to correspond with the longitudinal displacement of the tabs 19, are attached to the tabs in their respective planes. The rings 20 each have a gap (not shown) in the region between the input and output waveguides 13, 14, respectively. The waveguides 13, 14, shown in an exploded view of FIG. 1, are connected to the wall 18 of cavity 15 at apertures 21, 22, respectively, of wall 18. Each waveguide 13, 14 contains an impedance matching wedge 131, 141, respectively. The wedge may assume other forms such as a stepped ridge as is well known to those skilled in the art. Each wedge 131, 141 is electrically connected by a wire 132, 142 to a different one of the mode suppression rings $20_1$, $20_2$ of FIG. 2, respectively. Another wire 133, 143 is connected between each waveguide 13, 14 and the other ring $20_2$, $20_1$, respectively. Because the tube 10 is evacuated, each waveguide contains a vacuum seal 134 shown in FIG. 2. The upper wall 16 and the lower wall 17 of cavity 15 have a magnetic structure 23, 24 brazed to them respectively in order to provide a structure which will provide a longitudinally directed magnetic field when connected to a magnet (not shown). The magnetic structure 23 comprises two circular steel plates 231, 232 brazed to a soft iron disk 233. A vacuum tube 234 extending out beyond a central opening in magnetic structure 23 is sealed after the evacuation of an assembled tube. Magnetic structure 24, having plates 241, 242 and disk 433, is attached to the lower wall 17 of cavity 15. Magnetic structure 24 has a hole in its center through which the cathode support pipe 25 passes. A disk 26 forms a vacuum seal between the lower steel plate 241 of structure 24 and the high voltage insulator 27. Insulator 27 also is bonded to cathode support pipe 25 with a vacuum insulating seal. Thus, the tube 10 shown in FIG. 2 is a vacuum-tight structure.

The cathode structure 11 comprises the cathode support pipe 25 mentioned earlier to which is attached a cylindrical spool 29 having top and bottom walls 290, 295 both with edges 291 which protrude beyond the cylindrical wall 292 to form a recess in which is contained the secondary emitter semiconductor cathode material 293. The spool 29 has a region 294 between the wall 292 and the pipe 25 which is filled with water for water cooling of the cathode. For cooling, water entering inlet pipe 251 passes along the interior of pipe 25 to an exit port 253 where the water fills the region 294. The water in region 294 exits through port 252 which is connected to the interior of a pipe 254 which has an exit pipe 255 through which the cooling water exits. Pipe 25 has a threaded end 256 and engaging nut 257 to which the negative terminal of a high voltage power supply (not shown) is attached, the anode 12 being connected to ground.

Surrounding the outer wall 18 of the microwave cavity 15 is a concentric wall 30 which, in conjunction with extensions of the upper and lower walls 16, 17, respectively, of cavity 15, forms a chamber 31 through which water 32 flows in order to provide cooling for the anode 12. Ports 33, 34 provide entry points to the chamber 31 through which the water enters and exits, respectively.

The crossed-field tube 10 is shown in FIG. 1 without the magnet (not shown) which is required in order to provide a longitudinally directed magnetic field in the interaction region 35 which lies between the cathode secondary emission material 293 and the vanes 28. The magnet is constructed with north and south pole faces which slide into the recesses 235 and 236, respectively, of the magnetic structures 23, 24.

The cross-sectional view of the tube 10 shown in FIG. 2 shows more clearly than FIG. 1 some of the features of the tube 10. The view of FIG. 2 is taken along section line 2—2 of FIG. 1. FIG. 2 shows the vacuum seal 131 at the end of the waveguide 13. The impendance matching wedge 131 is shown connected by wire 132 to mode suppression ring $20_1$. Also shown is the connection of the other ring $20_2$ by wires 131 to the wall of the waveguide 13 where the waveguide terminates on wall 18 of cavity 15.

Figure 3:
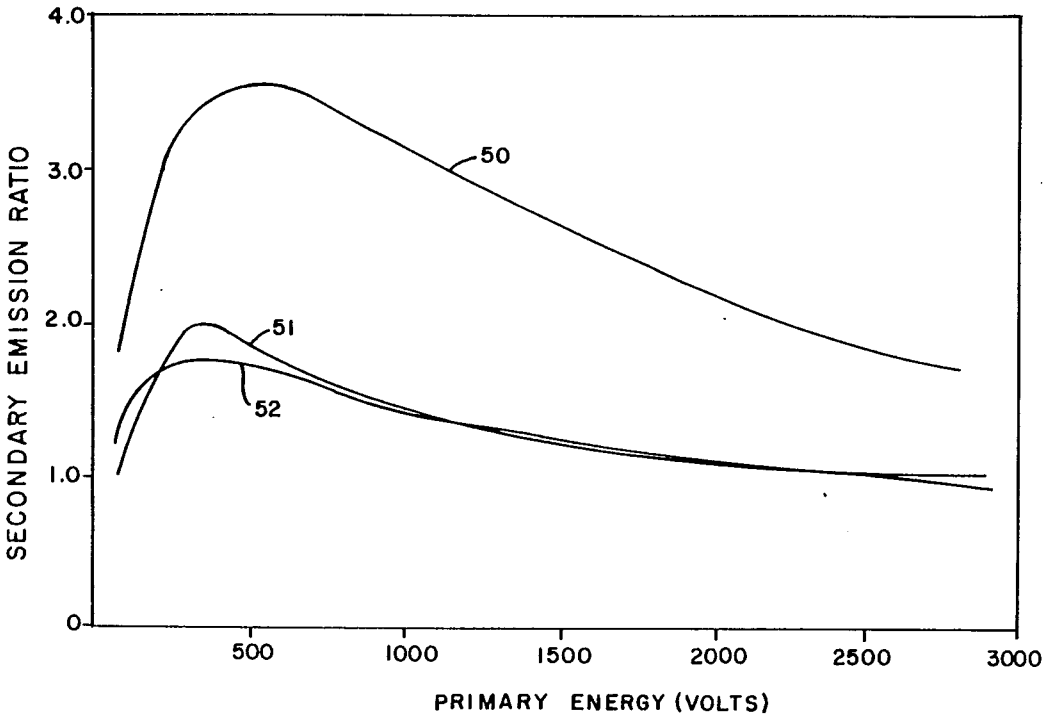
FIG. 3 (PRIOR ART)
FIG. 3 shows the secondary emission ratios of several semiconductor materials.

FIG. 3 shows curves of the secondary emission ratio as a function of impinging primary electron energy in volts for several semiconductors as disclosed in the prior art. Curves 50, 51 and 52 represent the secondary emission ratio for gallium arsenide, cadmium sulfide and cadmium telluride, respectively. The doping level, if any, is unknown to the inventors. This academically interesting phenomenon may exist in other semiconductors other than those recited. However, there was no suggestion in the prior art that semiconductors might be useful as secondary emission cathodes in crossed-field tubes where factors other than the secondary emission ratio property of the material is of vital importance. More specifically, semiconductor cathodes for use as secondary emitter cathodes in high power crossed-field amplifier tubes must, in addition to high secondary emission ratios, be relatively thick for long life while still being capable of providing high current densities for the current levels required in high-power crossed-field tubes. The semiconductor cathode must also have a low vapor pressure so that the vacuum required within the tube will not be contaminated by the vaporization of the semiconductor material of the cathode while under bombardment by the imparint electrons. Furthermore, the semiconductor cathode must be capable of withstanding for long periods of time the erosion (hence the thickness requirement) resulting from the bombardment by the high energy electrons which are returned to impart upon the cathode and produce the secondary emission. Therefore, a material which merely posesses a secondary emission ratio greater than one does not necessarily mean that the material would be useful as a cathode in a high-power crossed-field amplifier tube.

Figure 4A:
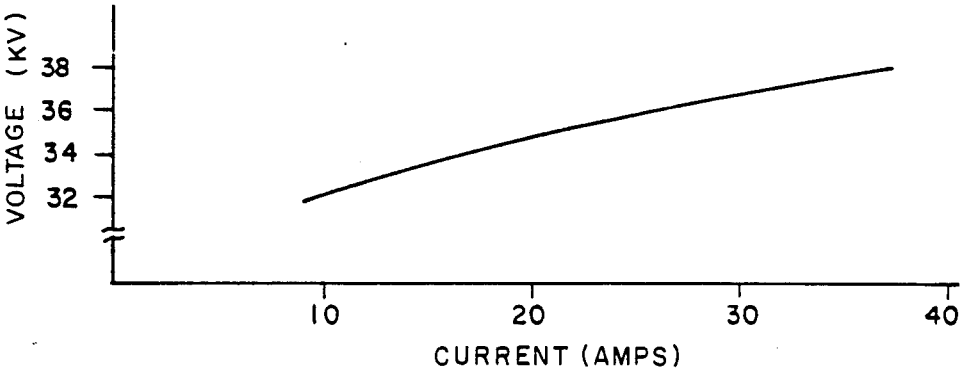
FIGS. 4A, 4B and 4C show performance curves of a cross-field amplifier tube made in accordance with this invention.
Figure 4B:
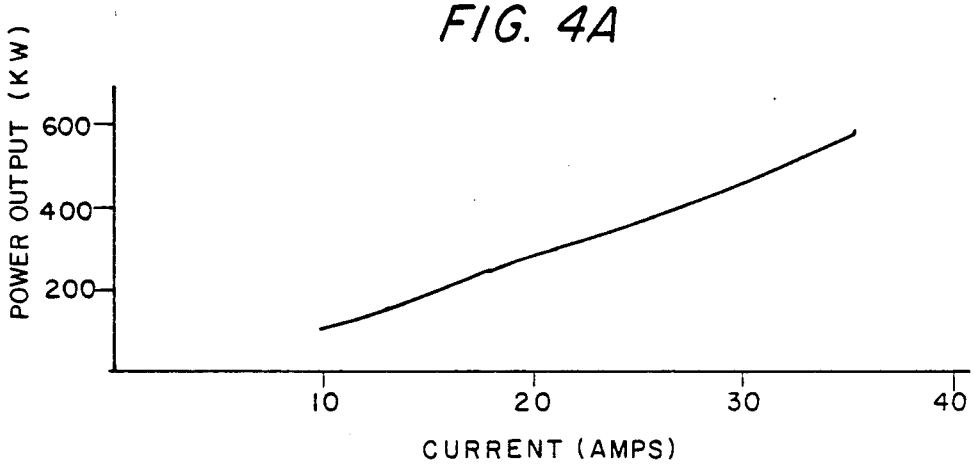
Figure 4C:
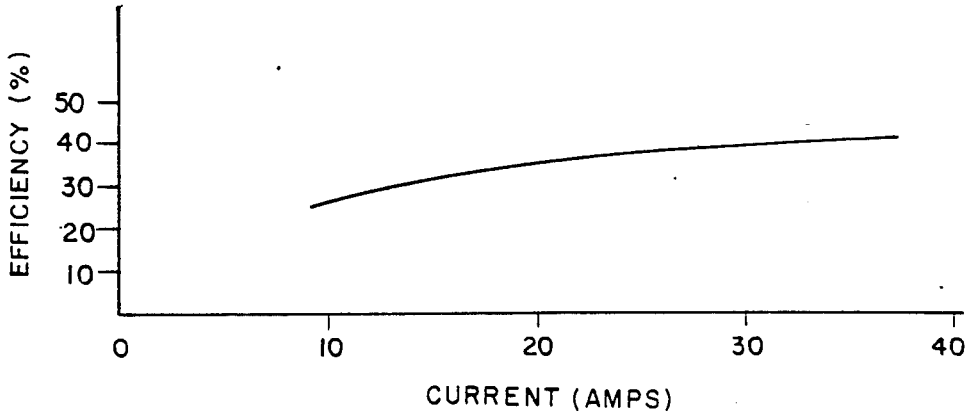

The voltage, power output, and efficiency of a crossed-field amplifier tube having a doped gallium arsenide semiconductor cathode is given in FIGS. 4A, 4B and 4C, respectively. In order to get the desired cathode current from the cathode material 293 for a cathode of approximately $\frac{3}{4}$ of an inch diameter, $\frac{5}{8}$ of an inch in length, and 50 Angstrom units thickness, it is necessary to dope the intrinsic semiconductor with conventional doping materials to cause the semiconductor to have sufficient conductivity to provide the necessary numbers of electrons at the required current density. The experimental data of FIGS. 4A, 4B and 4C was obtained with a cathode of the previously stated dimensions having a p-type doping density of $10^{19}$ holes per cubic centimeter. Higher currents than that shown were achievable. However, different doping levels with P-type dopants and N-type dopants function satisfactorily depending upon the current density required for the cathode material and the thickness thereof. The choice of the semiconductor, dopant, and the doping density are to some extent determined by the allowable vapor pressure, bambardment resistance, and current density required.

Greater thickness of cathode material 293 would result in longer lifetime of the cathode, although the lifetime of the 50 Angstroms thick gallium arsenide cathode has not been experimentally determined. With this cathode material, the conductivity is not a limitation on the allowable thickness, and hence life of the tube, and thicknesses of 500,000 Angstroms are reasonable. The Gallium arsenide cathode resulted in a tube with a very fast rise time on the output pulse and very small leading-edge output pulse jitter relative to that obtained from a comparable tube with a conventional MgO cathode. The low cross-over value (20 volts approximately) of the semiconductor cathode contributes to the lower jitter starting characteristic. Another advantage of the semiconductor cathode of this invention is that the high secondary emission relative to prior art cathodes allows higher pulsed powers to be obtained than is available from tubes using the same size prior art cathodes. Therefore, smaller tubes may be provided to get the same output as from larger prior art tubes. The advantage of employing a smaller size tube to provide given level output power is that less mode interference is obtained the smaller the size of the interaction space 35.

Having described a preferred embodiment of the invention it will be apparent to one skilled in the art that other embodiments incorporating its concept may be used. It is believed therefore that this invention should not be restricted to the disclosed embodiment but rather should be limited only by the spirit and scope of the appended claims.

What is claimed is:

1. A crossed-field amplifier tube of the type having a secondary emission cathode;

an anode with a slow-wave structure adjacent said cathode forming an interaction space between said slow-wave structure and said cathode;

a portion of the electrons emitted from the surface of said cathode being returned by the interaction with an electric field between said cathode and anode and a transverse magnetic field in the interaction space to impact the surface of said cathode to cause said returned electrons to produce secondary electron emission from said surface;

said anode and cathode being adapted to have a voltage source applied therebetween to provide said electric field between said anode and cathode, said cathode being a cold cathode having a single electrode;

waveguide means adapted to carry electromagnetic field energy connected to said slow-wave structure for coupling into and out of said tube; and the improvement comprising said cathode being a semiconductor having a secondary emission ratio greater than one in response to said electromagnetic field energy acting upon said cathode from said slow-wave structure.

2. The tube of claim 1 wherein said tube is an amplifier tube;

waveguide means comprises an input waveguide and an output waveguide both connected to said anode slow-wave structure.

3. The amplifier tube of claim 2 wherein said semiconductor cathode contains a doping material which increases its electrical conductivity.

4. The amplifier tube of claim 3 wherein said doping material is of a p-type material.

5. The amplifier tube of claim 3 wherein said doping material is an n-type material.

6. The amplifier tube of claim 3 wherein said semiconductor material is selected from the group containing gallium arsenide, cadmium sulfide, and cadmium telluride.

7. The amplifier tube of claim 4 wherein said semiconductor material is p-type gallium arsenide.

8. The amplifier tube of claim 7 wherein said p-type gallium arsenide has a doping concentration of $10^{19}$ holes per centimeter cubed.

9. A source of secondary electrons comprising:

a semiconductor cathode, said semiconductor having a secondary emission ratio greater than one in response to an applied electromagnetic field;

means for producing emitted electrons from one surface of said cathode; and means for causing a portion of said emitted electrons to return to said surface to produce secondary emission of emitted electrons from said surface.

10. The source of secondary electrons of claim 9 wherein said means for causing comprises:

an electric field transverse to said cathode surface; and a magnetic field transverse to said electric field.

11. The semiconductor cathode of claim 9 containing doping material to increase its electrical conductivity.

12. The semiconductor cathode of claim 11 wherein said doping material is a p-type material.

13. The semiconductor cathode of claim 11 wherein said doping material is an n-type material.

14. The semiconductor cathode of claim 11 wherein said semiconductor material is selected from the group containing gallium arsenide, cadmium sulfide, and cadmium telluride.

15. The semiconductor cathode of claim 12 wherein said semiconductor material is p-type gallium arsenide.

16. The semiconductor cathode of claim 15 wherein said p-type gallium arsenide has a doping concentration of $10^{19}$ holes per centimeter cubed.

* * * * *